US005491054A

United States Patent [19]

Jain et al.

[11] Patent Number: 5,491,054

[45] Date of Patent: Feb. 13, 1996

[54] PHOTOGRAPHIC ELEMENTS CONTAINING 2-EQUIVALENT PYRAZOLONE MAGENTA DYE FORMING COUPLERS AND STABILIZING COMPOUNDS

[75] Inventors: Rakesh Jain, Penfield; William R. Schleigh, Rochester; Robert C. Stewart, Spencerport, all of N.Y.

[73] Assignee: Eastman Kodak Company, Rochester, N.Y.

[21] Appl. No.: 361,922

[22] Filed: Dec. 22, 1994

[51] Int. Cl.[6] ..... G03C 7/384; G03C 7/392

[52] U.S. Cl. ..... 430/551; 430/555

[58] Field of Search ..... 430/555, 551

[56] References Cited

U.S. PATENT DOCUMENTS

| | | | |
|---|---|---|---|
| 4,994,360 | 2/1991 | Yoshimoto et al. | 430/551 |
| 5,017,465 | 5/1991 | Nishijima | 430/551 |
| 5,049,482 | 9/1991 | Nishijima et al. | 430/555 |
| 5,145,766 | 9/1992 | Leppard et al. | 430/372 |
| 5,236,819 | 8/1993 | Kakokura et al. | 430/551 |
| 5,248,586 | 9/1993 | Nagaoka et al. | 430/551 |
| 5,362,615 | 11/1994 | Hagemann et al. | 430/551 |

FOREIGN PATENT DOCUMENTS

| | | | |
|---|---|---|---|
| 0486216 | 5/1992 | European Pat. Off. . | |
| 585546 | 3/1994 | European Pat. Off. . | |
| 0011453 | 2/1981 | Japan | 430/551 |
| 0085748 | 7/1981 | Japan | 430/555 |

*Primary Examiner*—Lee C. Wright

*Attorney, Agent, or Firm*—Gordon M. Stewart

[57] ABSTRACT

A silver halide photographic element comprising a light sensitive silver halide containing layer which also contains a 2-equivalent pyrazolone magenta coupler, a thiomorpholine dioxide compound which has an alkoxy substituted aryl group substituent on the ring nitrogen, a compound of formula (I) below, and a hydroquinone compound of formula (R) below:

(I)

(R)

wherein:

$R_3$, $R_4$ and $R_{31}$ are independently an alkyl group or H; $R_{11}$, $R_{12}$ and $R_{21}$ are alkyl groups.

The presence of the compound (I) when used with the two-equivalent pyrazolone magenta coupler and compounds (R) and (S), can result in a photographic element with low printout and/or thermal discoloration problems.

13 Claims, No Drawings

PHOTOGRAPHIC ELEMENTS CONTAINING 2-EQUIVALENT PYRAZOLONE MAGENTA DYE FORMING COUPLERS AND STABILIZING COMPOUNDS

FIELD OF THE INVENTION

This invention relates to photographic elements containing particular two-equivalent magenta dye forming couplers, and compounds which can reduce printout and/or thermal discoloration in such elements.

BACKGROUND OF THE INVENTION

In a silver halide photographic element, a color image is formed when the material is exposed to light and then subjected to color development with a primary amine developer. The color development results in imagewise reduction of silver halide and production of oxidized developer. The oxidized primary anline developer subsequently reacts with one or more incorporated dye-forming couplers to form dye in an imagewise fashion. Some couplers, referred to as DIR couplers, release a development inhibitor compound or fragment upon coupling with the oxidized primary amine developer. Further, some of these DIR couplers release the inhibitor compound or fragment with a time delay. These are sometimes referred to as DIAR couplers.

A variety of magenta dye-forming coupler types have been used in color photographic materials. 2-Equivalent pyrazolone magenta dye forming couplers are known. Couplers are 2-equivalent where they require a total of 2 moles of silver to be developed to produce 1 mole of dye. Such couplers are advantageous over similar 4-equivalent couplers in that more dye is produced from the same amount of developed silver.

However, unreacted coupler typically remains following exposure and processing of a photographic element, in any area of the element which did not receive sufficient green light exposure to cause all of a magenta coupler to react with oxidized developer. Such unreacted coupler can react to cause color changes in the processed element over time. Such changes are particularly noticeable in areas which received little or no green light exposure since the processed element in those areas, would have little or no magenta dye. In the case of pyrazolone couplers, the problems in areas of little or no green light exposure, include a tendency to yellow upon exposure of the processed element to light ("printout" problem), and a tendency to form a pink stain over time particularly due to exposure of the processed element to heat ("thermal discoloration" sometimes referenced as "pinking").

Stabilizers are classes of compounds which reduce the image dye performance problem. Such stabilizers include phenols, bis-phenols, blocked phenols, blocked bis-phenols, metal and other organic complexes and other compounds, all of which have been described for use in conjunction with various color couplers. Photographic elements containing color coupler and stabilizer combinations are described, for example, in EP 0 298 321; EP 0 231 832; EP 0 161 577; EP 0 218 266; U.S. Pat. Nos. 3,043,697; 3,700,455; Kokai JP 62043-641, JP 01137-258, JP 01144-048; U.S. Pat. Nos. 4,782,011 and 4,748,100.

It would be desirable then, to provide a photographic element with a 2-equivalent pyrazolone magenta dye forming coupler, but in which printout and/or thermal discoloration problems are relatively low.

SUMMARY OF THE INVENTION

The present invention therefore provides a silver halide photographic element comprising a light sensitive silver halide containing layer which also contains a 2-equivalent pyrazolone magenta coupler, a thiomorpholine dioxide compound which has an alkoxy substituted aryl group substituent on the ring nitrogen, a compound of formula (I) below, and a hydroquinone compound of formula (R) below:

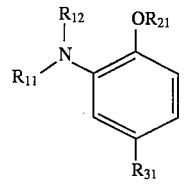

(I)

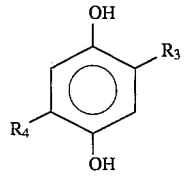

(R)

wherein:

$R_3$, $R_4$ and $R_{31}$ are independently an alkyl group or H; and $R_{11}$, $R_{12}$ and $R_{21}$ are alkyl groups.

Photographic elements containing a composition of the present invention, have low printout and/or thermal discoloration problems. The magenta dye produced in elements of the present invention, can also have a maximum absorption shifted to longer wavelengths and an increased bandwidth, than if the same coupler is used in the absence of compounds (S), (I) and (R). Both of the foregoing features can enhance color reproduction.

EMBODIMENTS OF THE INVENTION

It should be noted that throughout this application a reference to any type of chemical "group" includes both the unsubstituted and substituted forms of the group described. Generally, unless otherwise specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularl lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

The above described thiomorpholine dioxide compound is preferably of formula (S) below:

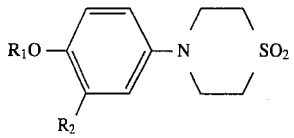

(S)

wherein $R_1$ is an alkyl group, and $R_2$ is an alkyl group or H. However, it will be appreciated that more broadly the thiomorpholine dioxide compound could, for example, be similar to that of compound (S) but the $R_1O$- may be meta or para to the thiomorpholine dioxide ring N, and any of the phenyl ring and the carbon atoms of the thiomorpholine dioxide ring, could be substituted with any of those substituents described above.

In formula (S), $R_1$ may, for example, have 1 to 30 carbon atoms (or even 1 to 20, or 1 to 15 carbon atoms). When $R_2$ is an alkyl group, it may particularly have, for example, from 1 to 30 carbon atoms (or even 1 to 20, 1 to 10, 1 to 6, or 1 to 4 carbon atoms).

Specific examples of thiomorpholine dioxide stabilzers for use in the elements of the present invention, include the following:

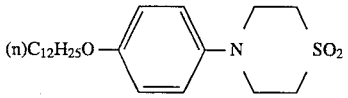

(S-1)

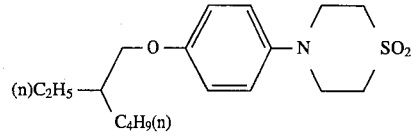

(S-2)

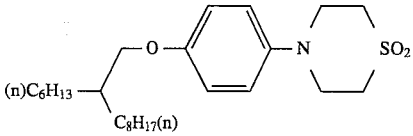

(S-3)

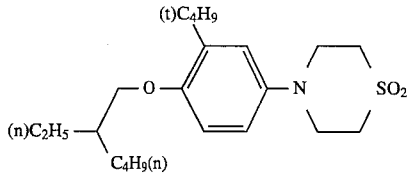

(S-4)

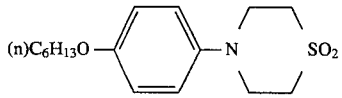

(S-5)

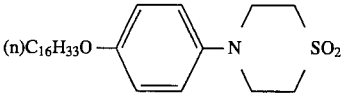

(S-6)

In formula (I), alkyl groups for each of $R_{11}$, $R_{12}$, $R_{21}$ and $R_{31}$, may particularly include any of those alkyl groups having from 1 to 30 carbon atoms (or even 1 to 20, 1 to 10, 1 to 6, or 1 to 4 carbon atoms). Examples of compounds of formula (I) include the following:

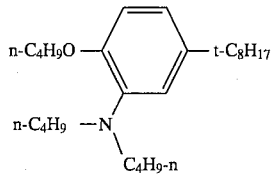

(I-1)

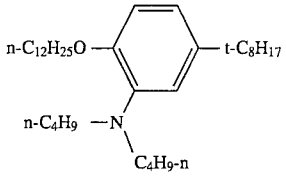

(I-2)

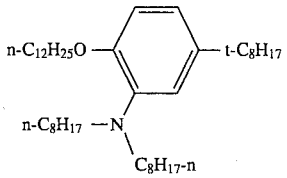

(I-3)

Specific examples of the compound of formula (R) include $R_1$ and $R_2$ below:

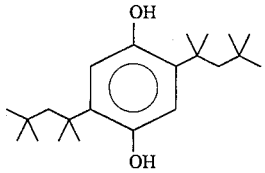

(R-1)

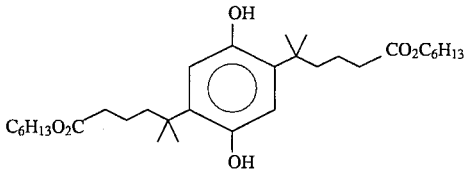

(R-2)

Further examples of compounds of formula (R) can be found in U.S. Pat. Nos. 4,748,100; 5,006,454; 3,982,944; and 4,906,559, which are incorporated herein by reference.

The 2-equivalent pyrazolone magenta dye forming coupler is preferably of formula (M) below:

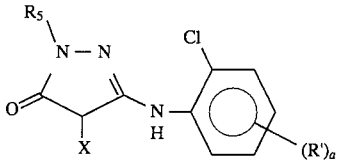

(M)

wherein $R_5$ is an aryl group, X is a group, other than H, which is cleaved upon reaction of the coupler with oxidized developer, a is an integer of from 0 to 4 (preferably 1), and R' is a ballast.

Examples of $R_5$ include a phenyl group which, when substituted, has substituents which may particularly be selected from substituents including the following: halogen, such as chlorine (for example, $R_5$ may be 1,3,5-trichlorphenyl or 1,5-dichlorophenyl), bromine or fluorine; alkyl or aryl, including straight or branched chain alkyl, such as those containing 1 to 30 carbon atoms, for example methyl, trifluoromethyl, ethyl, t-butyl, and tetradecyl; alkoxy, such as alkoxy containing 1 to 30 carbon atoms, for example methoxy, ethoxy, 2-ethylhexyloxy and tetradecyloxy; aryloxy, such as phenoxy, α- or β-naphthyloxy, and 4-tolyloxy; acylamino, such as acetamido, benzamido, butyramido, tetradecanamido, α-(2,4-di-t-pentylphenoxy)-acetamido, α-(2, 4-di-t-pentylphenoxy)butyramido, α-(3-pentadecylphenoxy)hexanamido, α-(4-hydroxy-3-t-butylphenoxy)tetradecanamido, 2-oxo-pyrrolidin-1-yl, 2-oxo-5-tetradecyl-pyrrolin-1-yl, N-methyltetradecanamido, and t-butylcarbonamido; sulfonamido, such as methanesulfonamido, benzenesulfonamido, p-toluenesulfonamido, p-dodecylbenzenesulfonamido, N-methyltetradecylsulfonamido, and hexadecanesulfonamido; sulfamoyl, such as N-methylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]-sulfamoyl, N-methyl-N-tetradecylsulfamoyl, and N-dodecylsulfamoyl; sulfamido, such as N-methylsulfamido and N-octadecylsulfamido; carbamoyl, such as N-methylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; diacylamino, such as N-succinimido, N-phthalimido, 2,5-dioxo-1-oxazolidinyl, 3-dodecyl-2,5-dioxo-1-imidazolyl, and N-acetyl-N-dodecylamino; aryloxycarbonyl, such as phenoxycarbonyl and p-dodecyloxyphenoxy carbonyl; alkoxycarbonyl, such as alkoxycarbonyl containing 2 to 30 carbon atoms, for example methoxycarbonyl, tetradecyloxycarbonyl, ethoxycarbonyl, benzyloxycarbonyl, and dodecyloxycarbonyl; alkoxysulfonyl, such as alkoxysulfonyl containing 1 to 30 carbon atoms, for example methoxysulfonyl, octyloxysulfonyl, tetradecyloxysulfonyl, and 2-ethylhexyloxysulfonyl; aryloxysulfonyl, such as phenoxysulfonyl, 2,4-di-t-pentylphenoxysulfonyl; alkanesulfonyl, such as alkanesulfonyl containing 1 to 30 carbon atoms, for example methanesulfonyl, octanesulfonyl, 2-ethylhexanesulfonyl, and hexadecanesulfonyl; arenesulfonyl, such as benzenesulfonyl, 4-nonylbenzenesulfonyl, and p-toluenesulfonyl; alkylthio, such as alkylthio containing 1 to 22 carbon atoms, for example ethylthio, octylthio, benzylthio, tetradecylthio, and 2-(2,4-di-t-pentylphenoxy)ethylthio; arylthio, such as phenylthio and p-tolylthio; alkoxycarbonylamino, such as ethoxycarbonylamino, benzyloxycarbonylamino, and hexadecyloxycarbonylamino; alkylureido, such as N-methylureido, N,N-dimethylureido, N-methyl-N-dodecylureido, N-hexadecylureido, N,N-dioctadecylureido, and N,N-dioctyl-N'-ethyl-ureido; acyloxy, such as acetyloxy, benzoyloxy, octadecanoyloxy, p-dodecanamidobenzoyloxy, and cyclohexanecarbonyloxy; nitro; cyano; carboxy and heterocyclic where preferably the foregoing organic substituents contain not more than 30 and preferably not more than 20 carbon atoms.

X can be any group, other than H, which is cleaved upon reaction of the coupler molecule with oxidized developer, such that the coupler is a 2-equivalent coupler. X may particularly be, for example, of the formula —S—Y where Y is an alkyl (such as a 1 to 20 carbon atom alky group) or aryl group (such as a 6 to 18 carbon atom aryl group). For example X may be of the formula:

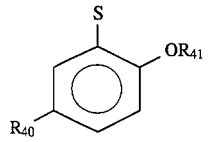

wherein $R_{40}$ and $R_{41}$ are, independently, alkyl, for example of 1 to 20 (or 1 to 10) carbon atoms (for example, butyl, t-octyl).

Preferably X is of formula (i) belows, and more preferably of formula (ii) below:

(i)

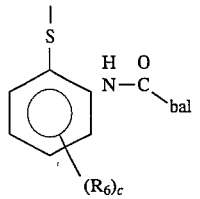

wherein bal is a ballast group, c is an integer from 0 to 4 (preferably 0), and each $R_6$ is a substituent;

(ii)

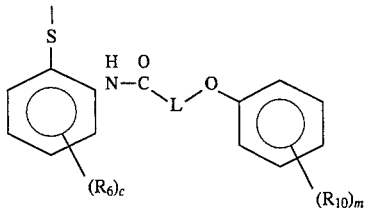

wherein m is an integer from 0 to 5, c is an integer from 0 to 4 (preferably 0), each $R_6$ is a substituent, each $R_{10}$ is an alkyl group, and L is a methine group.

Examples of R', $R_6$ and $R_{10}$ include any of the above substituents on the phenyl of $R_5$. The methine group, L, may have one substituent selected from alkyl, aryl, and heterocyclic group. However, L is preferably an unsubstituted methine (that is, L is preferably —$CH_2$—). Examples of 2-equivalent pyrazolone magenta couplers which can be used in elements of the present invention, are shown below, with A representing the coupling portion of the formula (M), while Q is the coupling off group X in formula (M):

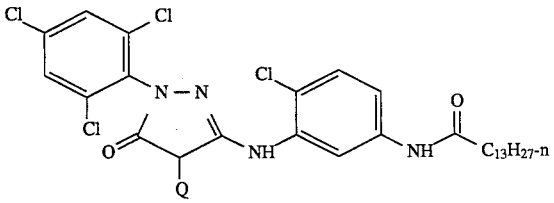

A-1

-continued
A-2
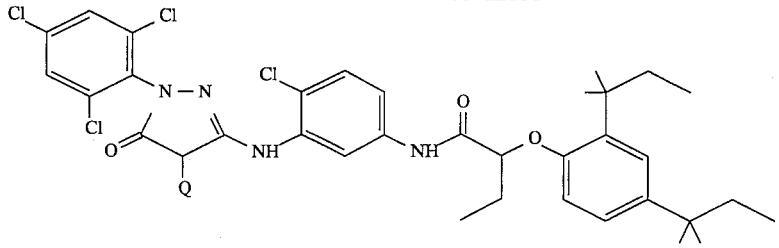
A-3
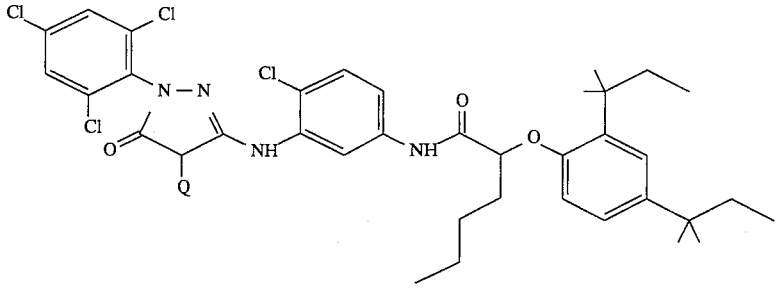
A-4
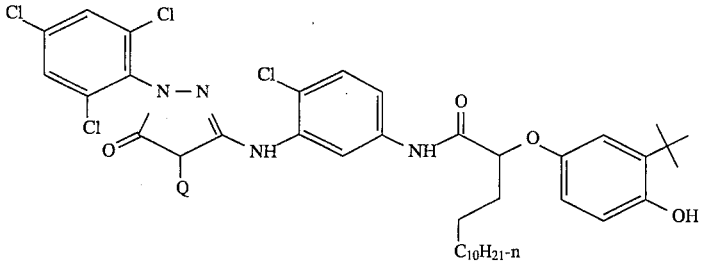
A-5
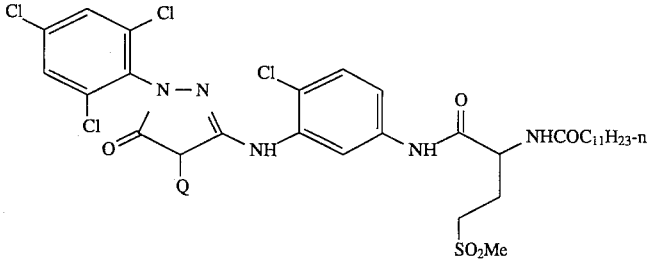
A-6
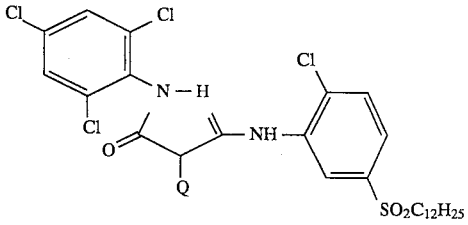
A-7
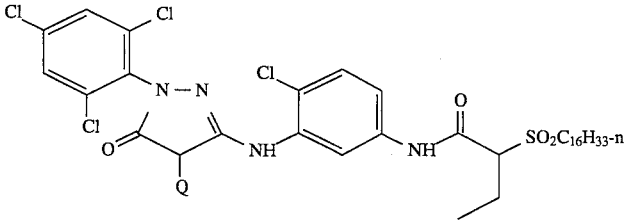

-continued
A-8
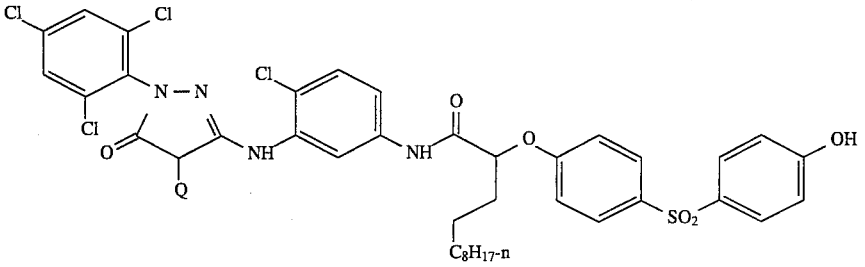
A-9
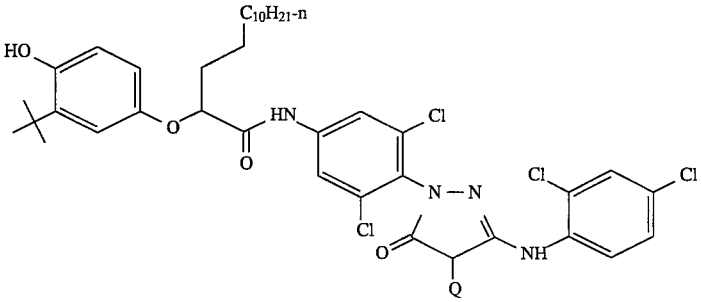
A-10
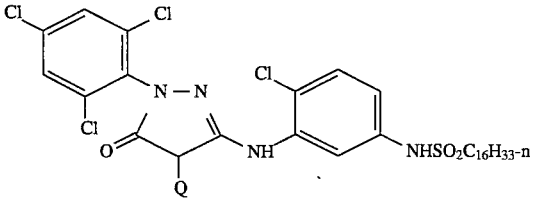
A-11
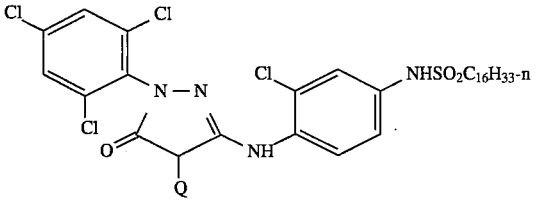
A-12
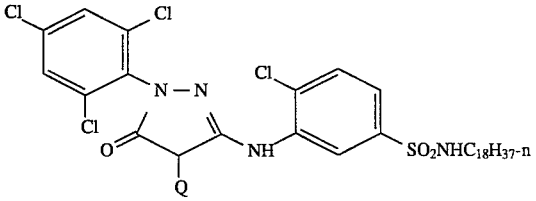
A-13
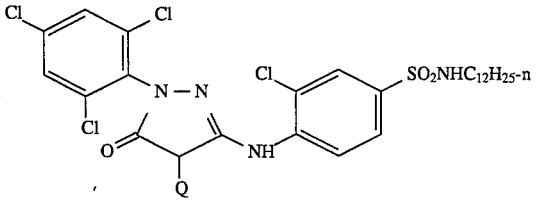
A-14
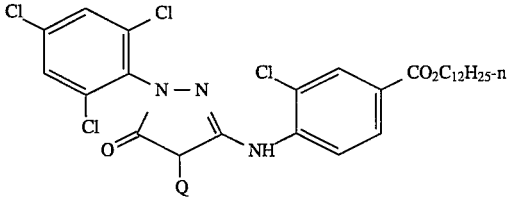

-continued
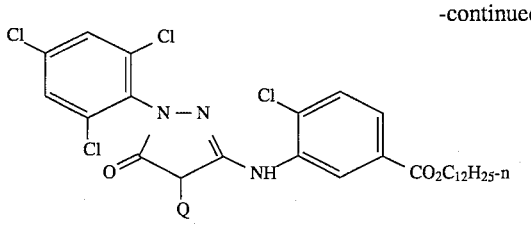
A-15
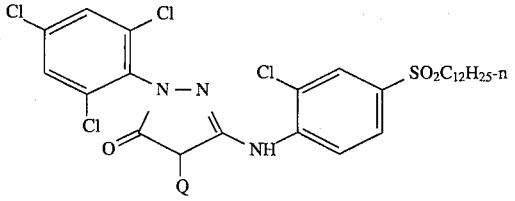
A-16
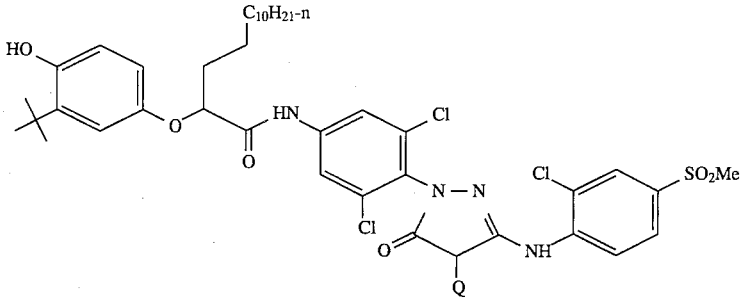
A-17
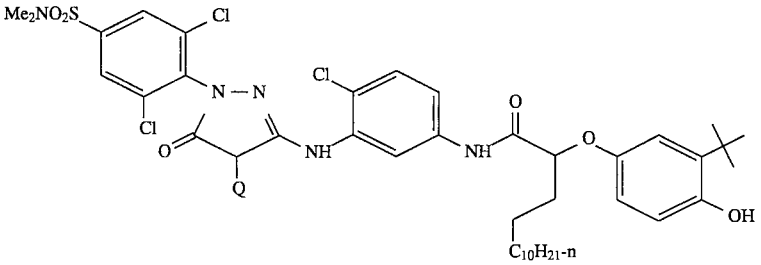
A-18
Q herein represents the coupling-off group X in formula (M). Illustrative coupling-off groups Q are below, with the sulfur bond to the 4-carbon of the pyrazolone understood. Each of the groups Q may be used on each of the formula A-1 through A-18 above:
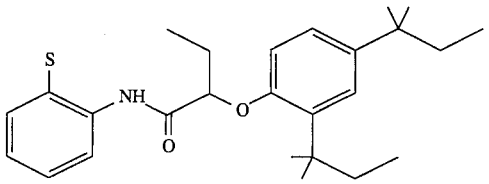
Q-1
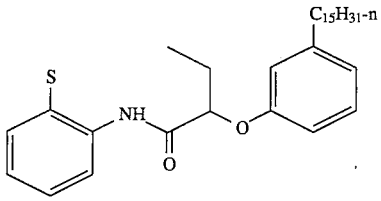
Q-2
-continued
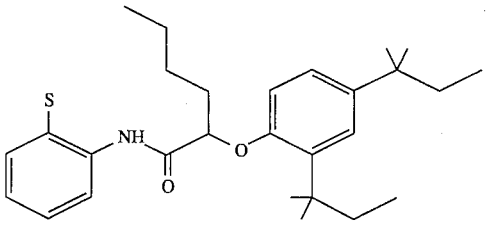
Q-3
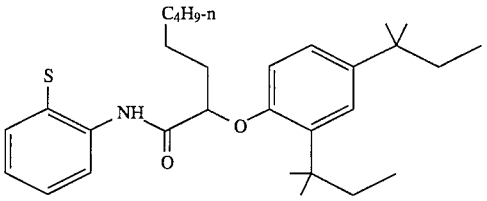
Q-4
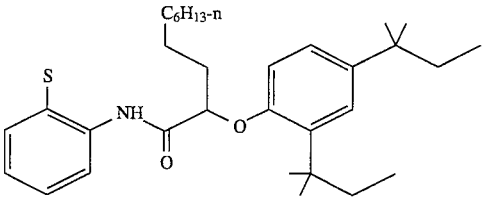
Q-5

-continued
Q-6
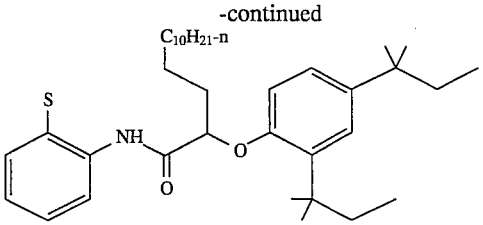
Q-7
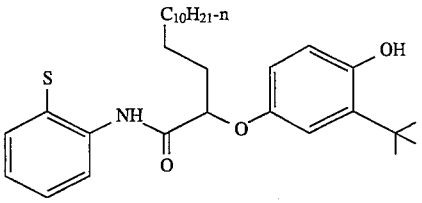
Q-8
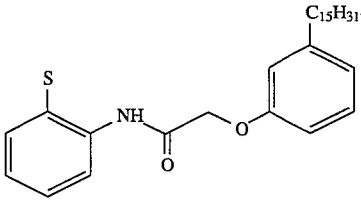
Q-9
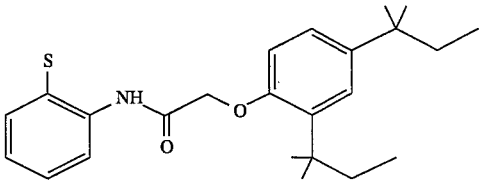
Q-10
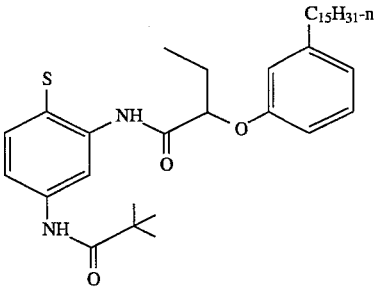
Q-11
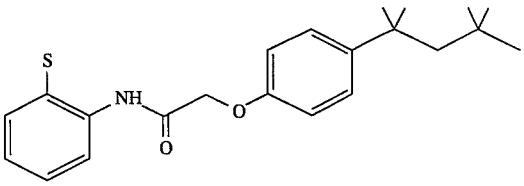
Q-12
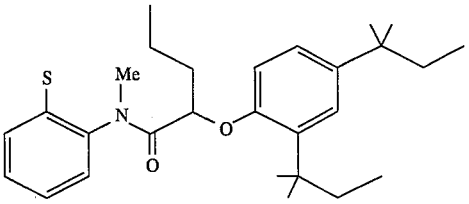
-continued
Q-13
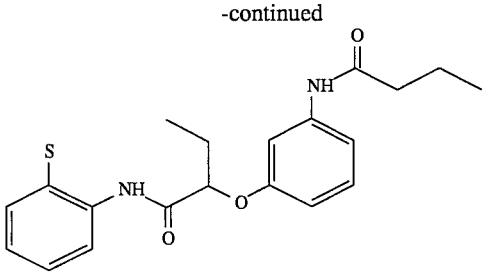
Q-14
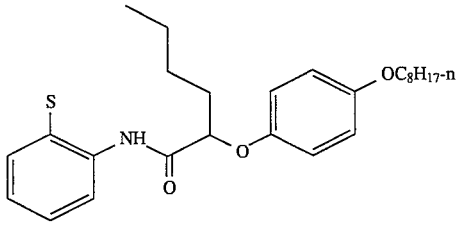
Q-15
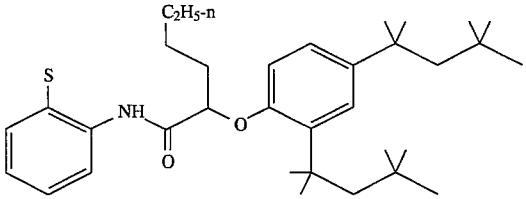
Q-16
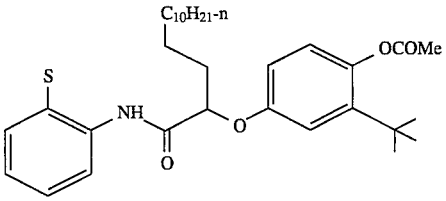
Q-17
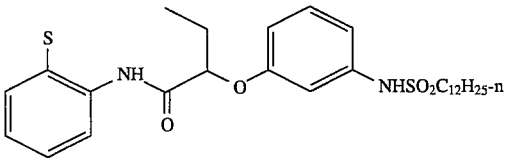
Q-18
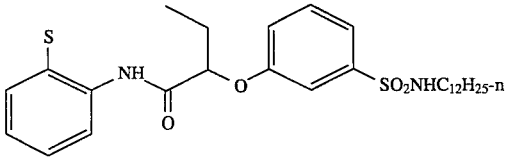
Q-19
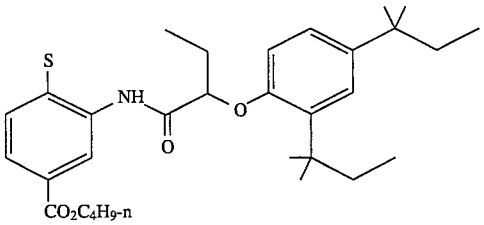
Q-20
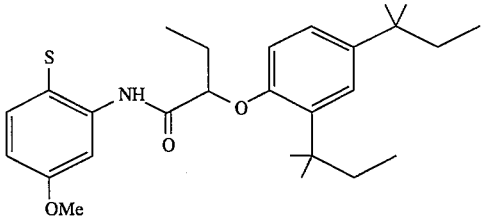

-continued

Q-21

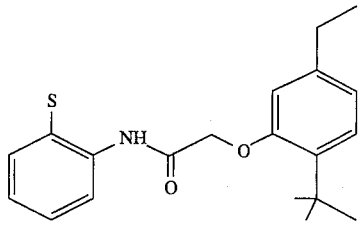

Q-22

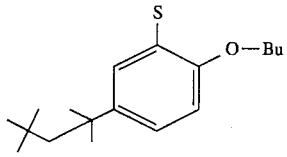

In particular, 2-equivalent pyrazolone couplers of formula (M) may include the following:

| Coupler Idenfication | Coupling portion of formula A above | Coupling off group of formula O above |
|---|---|---|
| M-1 | A-16 | Q-8 |
| M-2 | A-16 | Q-21 |
| M-3 | A-16 | Q-1 |
| M-4 | A-13 | Q-1 |
| M-5 | A-1 | Q-22 |

Methods of preparing hydroquinone compounds of formula (R), and couplers of formula (M) are well known. Methods of preparing compounds of formula (S) and (I) are also known in the art. For example, such as shown in published Japanese patent applications (Kokai) JP 04364175 (application number 91-17834), JP 4072 (application number 91-26665), JP 04182468 (application number 90-310271), and JP 04026683 (application number 90-131758), as well as *Synthesis* Vol. 5, p. 417 (1982) Compounds of formula (S) can, for example, be prepared in a manner similar to that for compound (S-2) described below.

As to the amount of the above described stabilizers which may be used in the present invention, typically the total amount of compound (S), plus the amount of compound (I), plus compound (R) will, in total, range from about 0.8 to about 8.0 moles per mole of coupler, or 2.0 to 6.5, or particularly 2.5 to 5.0. The ratio by weight of (I) and (S) to (R) (that is "(I)+(S)/(R)") is preferably between 20/1 to 1/1, and more preferably 10/1 to 2/1 (or even 68/1 to 2/1. Preferably then, the weight ratio of compound (R) to coupler is between 1/1 to 1/20 (preferably to 1/6), and the weight ratio of compound (S) to (I) is 5/1 (more preferably 2/1 with 1/1 being mGst preferred). As to the amount of the 2-equivalent pyrazolone coupler, it is typically coated at from 0.20 to 0.40 mmol/m$^2$, and more preferably from 0.25 to 0.35 mmol/m$^2$.

It is possible to use compositions as described herein without the presence of compound (I), such as described in pending U.S. patent application title PHOTOGRAPHIC ELEMENTS CONTAINING 2-EQUIVALENT PYRAZOLONE MAGENTA DYE FORMING COUPLERS AND FADE REDUCING COMPOUNDS, by Rakesh Jain et al., filled on the same date as the present application (Attorney Docket No. 66377). That application and all other references cited herein are incorporated in this application by reference. While omitting compound (I) can produce a photographic element in which the magenta dye formed from the two-equivalent pyrazolone coupler exhibits less fade, omitting compound (I) tends to increase printout and/or thermal discoloration. Therefore, it is preferred that a compromise is made between the dye fade and printout and/or thermal discoloration, such that the present composition is used with those additional compounds as described in that application.

The photographic elements of the present invention can be black and white elements (for example, using magenta, cyan and yellow dye forming couplers), single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to Research Disclosure, September 1994, Number 365, Item 36544, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I.

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through V. Color materials and development modifiers are described in Sections V through XX. Vehicles which can be used in the elements of the present invention are described in Section II, and various additives such as brighteners, antifoggants, stabilizers, light absorbing and scattering materials, hardeners, coating aids, plasticizers, lubricants and matting agents are described, for example, in Sections VI through X and XI through XIV. Manufacturing methods are described in all of the sections, other layers and supports in Sections XI and XIV, processing methods and agents in Sections XIX and XX, and exposure alternatives in Section XVI.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. Nos. 4,420,556: and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4:,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in Photographic Science and Engineering, Vol. 13, p. 74 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements of the present invention may be silver iodobromide, silver bromide, silver chloride, silver chlorobromide, silver chloroiodobromide, and the like. The type of silver halide grains preferably include polymorphic, cubic, and octahedral. The grain size of the silver halide may have any distribution known to be useful in photographic compositions, and may be ether polydispersed or monodispersed. Particularly useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred to that aim tabular grain projected areas be satisfied with ultrathin ($t<0.06$ micron) tabular grains. Tabular grain thicknesses typically range down to about 0.02 micron. However, still lower tabular grain thicknesses are contemplated. For example, Daubendiek et al. U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in Research Disclosure, June 1975, item 13452 and U.S. Pat. No. 3,772,031.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, New York, 1977. In the case of processing a negative working element, th element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog unexposed silver halide (usually chemical or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido-)ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III)(e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The present invention will be further described in the examples below.

Preparative Example

Compound (S-2) was prepared by the method shown schematically and described in further detail below:

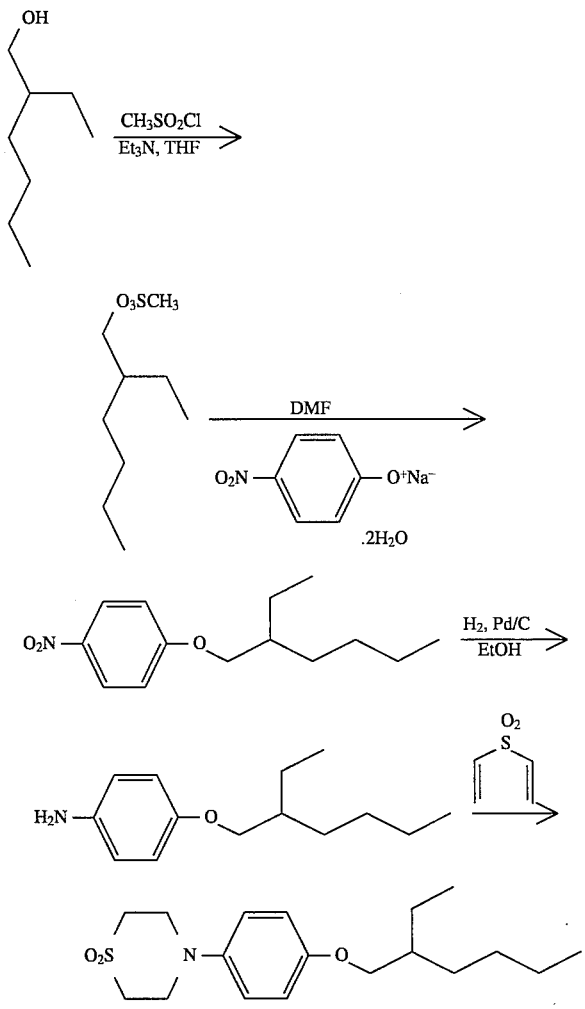

(S-2)

2-ethylhexanol (236.6 g, 1.82 mol) in 800 mL THF was mixed with methanesulfonyl chloride (250 g, 2.18 mol). The solution was cooled to 20° C. in an ice/acetone bath. Triethylamine (220.6 g, 2.18 mol) was then added dropwise maintaining the temperature between 25° and 29° C. The reaction mixture was then stirred at room temperature overnight. The triethylamine hydrochloride was removed by filtration and the resulting THF solution of the mesylate was concentrated to a pale yellow oil which used as such for the next step.

A mixture of sodium salt of p-nitrophenol (39.5 g, 0.2 mol), the mesylate (54.0 g, 0.25 mol), and DMF (160 mL) was heated for 2 days at 94 C. The mixture was then poured into a beaker containing ice and water. The resulting oil was taken up in ether, washed with water and saturated NaCl solution, dried over $Na_2SO_4$ and concentrated to yield a red/orange oil. The crude product was passed through a plug of silica gel, eluting with $CH_2Cl_2$. Upon concentration the product was obtained as a pale yellow oil. This material (15.0 g, 0.06 mol) was subjected to hydrogenation in a Parr apparatus (ethanol, 200 mL; palladium on carbon, 1 g). After hydrogen uptake ceased, the solution was filtered and to the filtrate was added divinyl sulfone (7.7 g, 0.065 mol). The reaction mixture was heated at reflux overnight and concentrated to get a viscous oil. Upon trituration with hexanes a crystalline solid (S-2) was obtained which was further purified by recrystallization from ethanol.

Photographic Examples

Dispersions of the couplers were prepared in the following manner. In one vessel, the coupler, coupler solvent, stabilizers, and ethyl acetate were combined and warmed to dissolve. In a second vessel, the gelatin, Alkanol XC™ (E. I. dupont Co.) and water were combined and passed three times through a Gaulin colloid mill. The ethyl acetate was removed by evaporation and water was added to restore the original weight after milling. The aim laydowns for various couplers was 0.33 mmol/sq m. The coupler solvent was coated 1:1 by weight of coupler, each stabilizer of compound (S) and (I) at 0.58:1 by weight of coupler, and the hydroquinone at 0.17:1 by weight of coupler.

Typical photographic elements were prepared by coating the following layers in the order listed on a resin-coated paper support below. In all of the examples the hydroquinone used was compound (R-2).

| | |
|---|---|
| 1st layer | |
| Gelatin | 3.23 g/m² |
| 2nd layer | |
| Gelatin | 1.61 g/m² |
| Coupler | 0.35 g/m² |
| Coupler solvent | 0.35 g/m² |
| Stabilizer S | 0.20 g/m² |
| Stabilizer I | 0.20 g/m² |
| Hydroquinone (compound (R)) | 0.06 g/m² |
| Green sensitized AgCl emulsion | 0.17 g/m² |
| 3rd layer | |
| Gelatin | 1.34 g/m² |
| 2-(2H-benzotriazol-2-yl)-4,6-bis-(1,1-dimethylpropyl)phenol | 0.73 g/m² |
| Tinuvin 326 ™ (Ciba-Geigy) | 0.13 g/m² |
| 4th layer | |
| Gelatin | 1.40 g/m² |
| Bis(vinylsulfonylmethyl) ether | 0.14 g/m² |

Some of the compounds used were as follows:

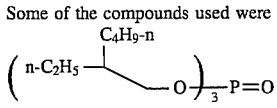

SOLV-1

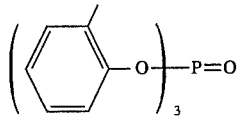

SOLV-2

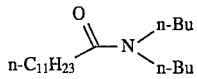

SOLV-3

Exposing And Processing Of Photographic Elements

The photographic elements were given stepwise exposures to green light and processed as follows at 35° C.:

| | |
|---|---|
| Developer | 45 seconds |
| Bleach-Fix | 45 seconds |
| Wash (running water) | 1 minute, 30 seconds |

The developer and bleach-fix were of the following compositions:

| Developer | |
|---|---|
| Water | 700.00 mL |
| Triethanolamine | 12.41 g |
| Blankophor REU™ (Mobay Corp.) | 2.30 g |
| Lithium polystyrene sulfonate (30%) | 0.30 g |
| N,N-Diethylhydroxylamine (85%) | 5.40 g |
| Lithium sulfate | 2.70 g |
| N-{2-[(4-amino-3-methylphenyl) ethylamino]ethyl}methanesulfonamide sesquisulfate | 5.00 g |
| 1-Hydroxyethyl-1,1-diphosphonic acid (60%) | 0.81 g |
| Potassium carbonate, anhydrous | 21.16 g |
| Potassium chloride | 1.60 g |
| Potassium bromide | 7.00 mg |
| Water to make | 1.00 L |
| pH @ 26.7° C. adjusted to 10.04 +/− 0.05 | |
| **Bleach Fix** | |
| Water | 700.00 mL |
| Solution of ammonium thiosulfate (54.4%) + ammonium sulfite (4%) | 127.40 g |
| Sodium metabisulfite | 10.00 g |
| Acetic acid (glacial) | 10.20 g |
| Solution of ammonium ferric ethylenediaminetetraacetate (44%) + ethylenediaminetetraacetic acid (3.5%) | 110.40 g |
| Water to make | 1.00 L |
| pH @ 26.7° C. adjusted to 5.5 +/− 0.1 | |

Photographic Tests

Magenta dyes were formed upon processing. The following photographic characteristics were determined: $D_{max}$ (the maximum density to green light); Speed (the relative log exposure required to yield a density to green light of 1.0); and Contrast (the ratio) (S-T)/0.6, where S is the density at a log exposure 0.3 units greater than the Speed value and T is the density at a log exposure 0.3 units less than the Speed value). No undesirable sensitometric changes were observed for any of the compounds (S), (R) or (I).

A set of exposed and processed coatings (see above) were irradiated with either a 50 klux high intensity daylight (HID) for 2 weeks. The change in Status A blue density in the Dmin areas as a result of exposure to radiation was then measured and used as a metric for printout. The change in Status A green density in the Dmin areas as a result of a 4 week thermal test at 75° C. and 50% relative humidity was also measured and used as a metric for thermal discoloration (referenced as "pinking" in Table I). The results are shown in Table I below.

TABLE I

| | Coupler | Coupler Solvent | Stabilizer (S) | Stabilizer (I) | 2 wk HID Printout | 4 wk 75/50 Pinking |
|---|---|---|---|---|---|---|
| Comparison | M-1 | SOLV-1 | S-3 | — | 9 | 16 |
| Comparison | M-1 | SOLV-1 | S-2 | — | 5 | 14 |
| Comparison | M-1 | SOLV-1 | S-4 | — | 7 | 13 |
| Comparison | M-2 | SOLV-1 | S-3 | — | 7 | 12 |
| Comparison | M-2 | SOLV-2 | S-3 | — | 13 | 21 |
| Comparison | M-3 | SOLV-1 | S-3 | — | 4 | 12 |
| Comparison | M-4 | S1034 | S-2 | — | 2 | |
| Invention | M-1 | SOLV-1 | S-2 | I-1 | 3 | 15 |
| Invention | M-1 | SOLV-1 | S-4 | I-1 | 5 | 14 |
| Invention | M-2 | SOLV-1 | S-3 | I-1 | 2 | 5 |
| Invention | M-3 | SOLV-1 | S-3 | I-1 | 2 | 8 |
| Invention | M-4 | SOLV-1 | S-3 | I-1 | 2 | 6 |
| Invention | M-4 | SOLV-2 | S-3 | I-1 | 1 | 3 |
| Invention | M-4 | S1034 | S-2 | I-1 | 1 | |

It will be seen from the above Tables I, that the present invention, in which compounds of formula (S) and (I) are used together with compounds of formula (R) and 2-equivalent pyrazolone magenta couplers, produces reduced printout and pinking over the case where the same coupler is used in identical conditions but without compound (I) present. The maximum absorption is shifted to a longer wavelength and the bandwidth increased in a manner similar to that shown in the co-pending application by Jain et al. filed on the same date as the present application (referenced above). However, the presence of Compound (I) tends to slightly decrease both of those effects provided by Compounds (S) and (R).

The preceding examples are set forth to illustrate specific embodiments of this invention and are not intended to limit the scope of the compositions or materials of the invention. It will be understood that variations and modifications can be effected within the spirit and scope of the invention.

We claim:

1. A silver halide photographic element comprising a light sensitive silver halide containing layer which layer also contains a 2-equivalent pyrazolone magenta coupler, a thiomorpholine dioxide compound which has an alkoxy substituted aryl group substituent on the ring nitrogen, a compound of formula (I) below, and a hydroquinone compound of formula (R) below:

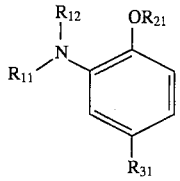

(I)

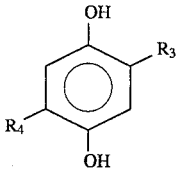

(R)

wherein:

$R_3$, $R_4$, $R_{11}$, $R_{12}$, $R_{21}$ and $R_{31}$ are independently an alkyl group or H.

2. A silver halide photographic element according to claim 1 in which the thiomorpholine dioxide compound is of formula (S) below:

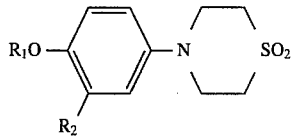

wherein $R_1$ is an alkyl group, and $R_2$ is an alkyl group or H.

3. A silver halide photographic element comprising a light sensitive silver halide containing layer which layer also contains a 2-equivalent pyrazolone magenta coupler of formula (M), a compound of formula (S) below, a compound of formula (I) below, and a hydroquinone compound of formula (R) below:

(M)

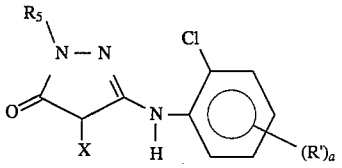

wherein $R_5$ is an aryl group, X is a group, other than H, which is cleaved upon reaction of the coupler with oxidized developer, a is an integer from 0 to 4, and R' is a ballast group;

(S)

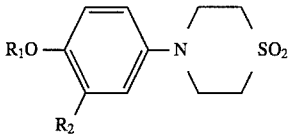

wherein $R_1$ is an alkyl group and $R_2$ is an alkyl group or H;

(I)

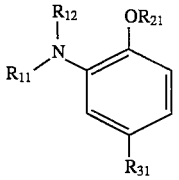

wherein $R_{11}$, $R_{12}$, $R_{21}$ and $R_{31}$ are independently an alkyl group or H;

(R)

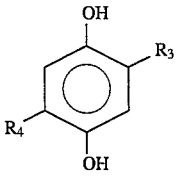

wherein:

$R_3$ and $R_4$ are, independently, an alkyl group or H.

4. A photographic element according to claim 3 wherein the 2-equivalent pyrazolone coupler has the formula (M-i) below:

(M-i)

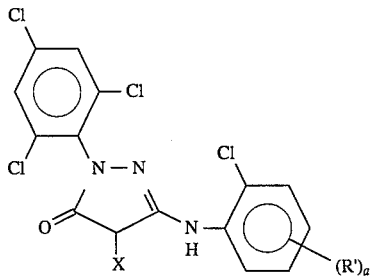

5. A photographic element according to claim 4 wherein X has the formula —S—Y where Y is an alkyl or aryl group.

6. A photographic element according to claim 4 wherein X has the formula:

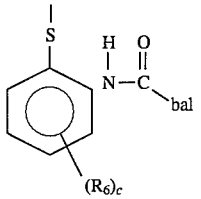

wherein bal is a ballast group, m is an integer from 0 to 4, and $R_6$ is a substituent.

7. A photographic element according to claim 4 wherein X has the formula:

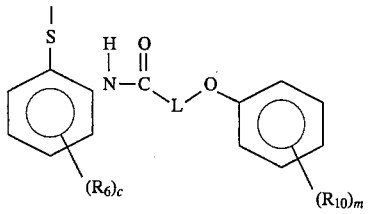

wherein c is an integer from 0 to 5, c is an integer from 0 to 4, each $R_6$ is a substituent, each $R_{10}$ is an alkyl group, and L is a methine group.

8. A photographic element according to claim 4 wherein R' sulfonyl or sulfamoyl group.

9. A photographic element according to claim 4 wherein the coupler of formula (M) and the compounds of formula (S) and (R) are contained in droplets of the same dispersion of a water immiscible organic solvent.

10. A photographic element according to claim 4 wherein the compounds of formula (S), (I) and (R) are present in a total amount of from 0.8 to 8.0 moles per mole of coupler of formula (M).

11. A photographic element according to claim 3 wherein in compound of formula (S), $R_1$ has from 1 to 20 carbon atoms and $R_2$, when alkyl, has from 1 to 20 carbon atoms.

12. A photographic element according to claim 3 wherein in compound of formula (R), $R_3$ and $R_4$ are alkyl groups and have, independently, from 1 to 20 carbon atoms.

13. A photographic element according to claim 3 wherein in the compound of formula (I), $R_{11}$, $R_{12}$, $R_{21}$ and $R_{31}$ are alkyl groups of from 1 to 20 carbon atoms, and may be the same or different.

* * * * *